US006647679B2

(12) United States Patent
Belleau

(10) Patent No.: US 6,647,679 B2
(45) Date of Patent: Nov. 18, 2003

(54) STUCCO TRIM ASSEMBLY

(76) Inventor: Michael Belleau, 34 Hazel St., Salem, MA (US) 01970

( * ) Notice: Subject to any disclaimer, the term of this patent is extended or adjusted under 35 U.S.C. 154(b) by 14 days.

(21) Appl. No.: 09/854,641

(22) Filed: May 14, 2001

(65) Prior Publication Data

US 2002/0023399 A1 Feb. 28, 2002

Related U.S. Application Data

(63) Continuation-in-part of application No. 09/407,452, filed on Sep. 28, 1999, which is a continuation-in-part of application No. 09/338,398, filed on Jun. 22, 1999, now Pat. No. 6,314,695.

(51) Int. Cl.[7] ..... E04B 1/00

(52) U.S. Cl. ..... 52/254; 52/255; 52/256; 52/257; 52/285; 52/286; 52/287.1; 52/288.1; 52/86; 52/466; 52/467; 52/586

(58) Field of Search ..... 52/255, 256, 257, 52/285, 586, 286, 86, 287.1, 288.1, 254, 466, 467

(56) References Cited

U.S. PATENT DOCUMENTS

| | | | | | |
|---|---|---|---|---|---|
| 2,163,613 | A | * | 6/1939 | Manofsky | 52/257 |
| 3,201,908 | A | * | 8/1965 | Arnold | 52/255 |
| 3,381,430 | A | * | 5/1968 | Wiczer | 52/282.3 |
| 3,688,460 | A | * | 9/1972 | Van Loghem et al. | 52/466 |
| 3,696,575 | A | * | 10/1972 | Armstrong | 52/288.1 |
| 4,315,390 | A | * | 2/1982 | Schaafsma | 52/287.1 |
| 4,385,850 | A | * | 5/1983 | Bobath | 403/205 |
| 4,430,833 | A | * | 2/1984 | Balzer et al. | 52/255 |
| 4,689,930 | A | * | 9/1987 | Menchetti | 52/275 |
| 4,840,440 | A | * | 6/1989 | Dieter | 217/65 |
| 4,924,649 | A | * | 5/1990 | Taylor | 403/402 |
| 4,964,252 | A | * | 10/1990 | Guliker | 220/1.5 |
| 5,022,719 | A | * | 6/1991 | Amstutz et al. | 312/140 |
| 5,531,051 | A | * | 7/1996 | Chenier et al. | 52/255 |
| 5,953,881 | A | * | 9/1999 | Sherry | 52/287.1 |
| 5,974,746 | A | * | 11/1999 | Mathias | 52/255 |
| 6,070,374 | A | * | 6/2000 | Bifano et al. | 52/255 |
| 6,219,980 | B1 | * | 4/2001 | Peck, Jr. | 52/288.1 |
| 6,318,039 | B1 | * | 11/2001 | Watson et al. | 52/288.1 |
| 6,345,480 | B1 | * | 2/2002 | Kemper et al. | 52/395 |

* cited by examiner

*Primary Examiner*—Carl D. Friedman
*Assistant Examiner*—Christy M. Green
(74) *Attorney, Agent, or Firm*—Don Halgren

(57) ABSTRACT

A stucco trim assembly for emplacement onto a corner defined by the juncture of a pair of walls, to permit a foam and/or a stucco material to be controllably applied and adjustably secured to the walls. The assembly comprises an elongated receiving trim member attachable to a corner of the pair of walls, and an elongated inserted frame clip. The clip is adjustably supported in the elongated receiving trim member a spaced distance from the wall.

9 Claims, 4 Drawing Sheets

STUCCO TRIM ASSEMBLY

This application is a continuation-in-part application of U.S. patent application Ser. No. 09/407,452 filed Sep. 28, 1999 which is a continuation-in-part application of my earlier filed U.S. patent application Ser. No. 09/338,398 filed Jun. 22, 1999 now U.S. Pat. No. 6,314,695 both of which applications are incorporated herein by reference, in their entirety.

BACKGROUND OF THE INVENTION

1. Filed of the Invention

This invention relates to the use of stucco as a wall appliqué with corner trim components to define the perimeter of stucco wall.

2. Prior Art

Stucco is a cementitious compound utilized as a building finish that is applied to the walls of those buildings, to make them weatherproof and have a finished appearance. Stucco is primarily utilized in the south and southwestern portions of the United States prior to the introduction of improved insulating techniques. Such techniques have led to improvements for use in wetter climates. Such an improvements have culminated into a development of a method and apparatus for the application of multiple layers of material to an existing wall, so as to produce a water impenetreble MASTERBOND™ stucco structure as described in my aforementioned patent applications.

A MASTERBOND™ stucco structure is processed by a series of steps. Such steps include pressure washing (if necessary) on the existing wall, which is then cleaned, rinsed and air dried. After the wall has been properly washed and dried, an arrangement of orientation screeds is applied to the margins of the wall including and inside or outside quarters thereon. A screed is a border support onto which the insulation is to be sprayed.

In my first aforementioned patent application, a screed is described having a ship-lap shape, or a cross-section of generally L-shaped having a shoulder on its spray foam-adjacent edge, so as to provide a key or locking affect onto that foam. The foam is also sprayed onto the wall surface. The screed in that embodiment is attached to the wall by an adhesive and/or mechanical fasteners.

It is an object of the present invention to provide a stucco trim assembly which is an improvement over the prior art trim arrangements.

It is a further object of the present invention to provide a stucco trim assembly which is of simple design and is inexpensive to manufacture.

It is a yet further object of the present invention, to provide a stucco trim or screed assembly which is adjustable in its assembly and adjustable in its stucco holding capacity.

It is still yet a further object of the present invention to provide a stucco trim assembly which is readily attachable to a wall and readily adjusted thereon by the personal applying the stucco coating.

BRIEF SUMMARY OF THE INVENTION

The present invention comprises a stucco trim assembly for emplacement on a corner of a wall to facilitate the securement and dimensional consistency of the stucco being placed thereon.

The stucco trim assembly, in a first embodiment, is configured for an outside or external corner emplacement.

The stucco trim assembly comprises an extruded elongated receiving trim member and an extruded elongated inserted frame clip. The elongated receiving trim member comprises an extruded component of plastic or metal having an elongated first securement web and an elongated second securement web meeting along a common juncture at an angle of 90 degrees. The elongated first securement web and the elongated second securement web each have a plurality of spaced apart perforations thereon, to provide a gripping surface for receipt of and securement of stucco when it is applied thereagainst and onto a wall surface.

A projecting channel frame is unitary with the juncture of the first securement web and the second securement web and is directed into a direction away from the first and second securement webs. The elongated projecting channel frame has a distalmost edge. The distalmost edge of the projecting channel frame has an elongated channel extending therewithin. The elongated channel has a plurality of elongated spaced apart barbs or ribs directed toward one another in an opposing fashion, within the elongated channel of the projecting channel frame.

The inserted frame clip of the first embodiment of the stucco trim assembly comprises an elongated central frame member having an elongated distalmost edge. The elongated central frame member has a second edge which defines a juncture for an elongated first outer web and an elongated second outer web unitarily extruded therewith and adjoined together at the second edge of the elongated central frame member. The elongated first outer web and the elongated second outer web each have an outer surface having a rough portion or texture thereon for bonding or securement of applied foam and stucco material thereto. The elongated central frame member has a plurality of elongated spaced apart ribs or barbs on each side thereof in spaced relationship to the opposed barbs spaced apart from one another within the channel of the projecting channel frame member of the receiving trim member.

The elongated frame member of the inserted frame is designed to be snapped (or slid) into the receiving channel of the projecting channel frame member at successively adjustable depths therewithin. The spaced apart barbs or ribs on the elongated frame member may be mated with the valleys between adjacent spaced apart and opposed ribs or barbs in the receiving channel of the projecting channel frame. The inserted frame clip may therefore define an outer surface which is adjustably matable within the channel of the receiving trim member to permit a foam and stucco material to be placed on a wall and within the boundaries defined by the stucco trim assembly, at any of several desired thicknesses, according to the needs of the construction undertaken.

A further embodiment of the stucco trim assembly comprises a receiving trim member for an inside or inner corner or a pair of walls meeting along an inner corner. The stucco trim assembly of this embodiment also includes an inserted frame clip arranged to adjustably mate with an elongated channel in the elongated projecting channel frame of the stucco trim assembly. The stucco trim assembly for this embodiment has a first securement web and a second securement web meeting at an elongated juncture, the first and second securement webs defining an angle of 90 degrees from one another. The elongated first and second securement webs in this embodiment, are bisected by the elongated projecting channel frame member. The inserted frame clip of this embodiment has a first outer web and a second out web which meet at an elongated unitary juncture comprising a second edge of the elongated frame portion thereof. The elongated first outer web and the elongated second outer web define an angle of 90 degrees with respect to one another along the elongated juncture. The elongated frame portion of this embodiment has a plurality of spaced apart ribs or barbs arranged in a matter similar to that of the aforementioned first embodiment. The receiving frame portion has an elongated channel disposed within the projecting channel frame in a manner similar to that of the aforementioned embodiment. The inserted frame portion of the inserted clip may be thus inserted within the channel of the receiving frame portion into a depth of any one of several distances so as to provide a selective spaced distance between the first outer web and the first securement web to permit controlled thickness adjustment of the foam and stucco material applied to the wall surfaces meeting at the inner wall juncture where the stucco trim assembly of this second embodiment, is placed.

Thus is what has been shown is a unique extruded assembly which permits guidance for application of foam and stucco material to adjacent wall surfaces, in a convenient and easily adjustable manner. The elongated outer webs or securement webs each having irregular surface characteristics permit bonding of the foam and stucco material thereto, facilitating securement and longevity to the stucco assembly.

The invention thus comprises a stucco trim assembly for emplacement onto a corner defined by the juncture of a pair of walls, to permit a foamf and stucco material to be controllably and adjustably secured to the walls. The assembly comprises an elongated receiving trim member attachable to a corner of said pair of walls; and an elongated inserted frame clip, wherein the clip is adjustably supported in the elongated receiving trim member a spaced distance from the wall. The receiving trim member comprises a pair of elongated web members which are joined at an angle at a common elongated juncture for attachment to the walls. The elongated inserted frame clip comprises a pair of elongated web members which are joined at an angle at a common elongated juncture, the web members arranged for securement to the foam and stucco material. The receiving trim member has a projecting channel frame portion for receiving the elongated inserted frame clip. The elongated web members are arranged at an angle of about 90 degrees with respect to one another. The web members have surfaces with a roughened texture for gripping of the foam and stucco material applied thereto. The projecting channel frame portion has an elongated channel therein for receipt of an elongated frame member of the inserted frame clip. The elongated channel in the projecting channel frame portion has a plurality of elongated spaced apart ribs thereon for securely receivingly engaging the inserted frame clip. The elongated frame member on the inserted frame clip has a plurality of elongated spaced apart ribs thereon for engaging the projecting channel frame portion of the receiving trim member.

The invention also comprises a method of adjustably setting and securing a desired thickness of the foam and stucco material to be applied to a pair of walls meeting at a corner, comprising the steps of: attaching an elongated receiving trim member to a corner of the pair of walls; inserting an elongated inserted frame clip to the elongated receiving trim member, wherein the clip is adjustably supported in the elongated receiving trim member a spaced distance from the wall; and applying a layer of foam and stucco material to the walls to a thickness corresponding to an outer surface of the inserted frame clip. The method may include the steps of adjusting the dimension separation of a web on the inserted frame clip with respect to a web on the elongated receiving trim member, wherein the receiving trim member has a channel therein arranged to adjustably receive an edge of the inserted frame clip; and arranging a plurality of spaced apart ribs on a surface of the channel so as to permit adjustable receipt of the edge of the frame clip therein.

BRIEF DESCRIPTION OF THE DRAWINGS

The objects and advantages of the present invention will become more apparent, when viewed in conjunction with the following drawings in which.

DESCRIPTION OF THE PREFERRED EMBODIMENTS

Figure 1:
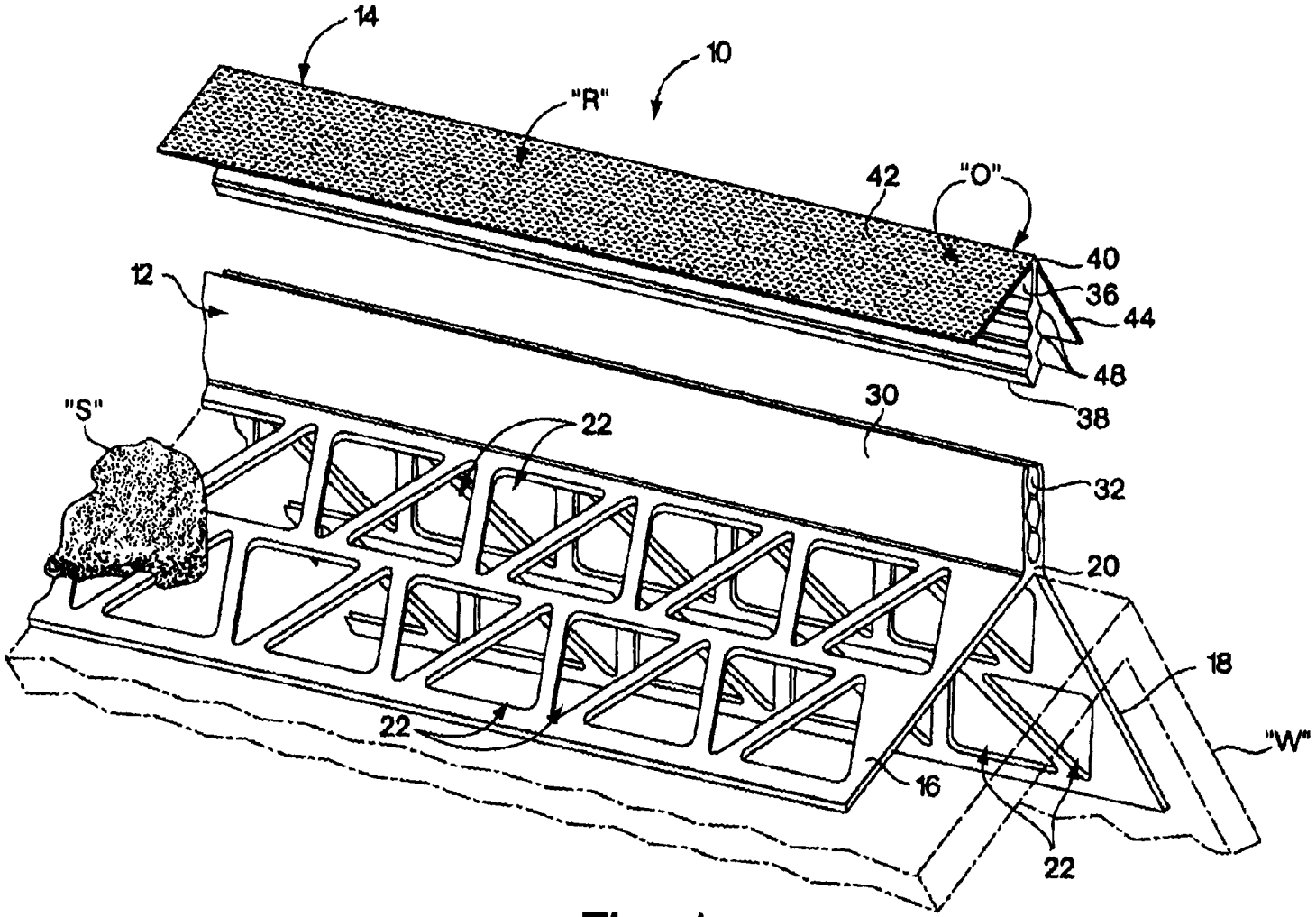
FIG. 1 is a perspective view of a stucco trim assembly in an exploded configuration, which stucco trim assembly is applicable for an outside corner of a wall component.

Referring now to the drawings in detail, and particularly to FIG. 1, there is shown the present invention which comprises a stucco trim assembly 10 for emplacement on a corner of a wall, (shown in phantom in FIG. 1) to facilitate the securement and dimensional consistency of the layer(s) of foam and/or stucco "S" being placed thereon.

The stucco trim assembly 10, in a first embodiment, is configured for an outside or external corner wall "W" emplacement, as represented in FIG. 1. The stucco trim assembly 10 comprises an extruded elongated receiving trim member 12 and an extruded elongated inserted frame clip 14. The elongated receiving trim member 12 comprises an extruded component of plastic or metal having an elongated first securement web 16 and an elongated second securement web 18 meeting along an elongated common juncture 20 at an angle of 90 degrees. The elongated first securement web 16 and the elongated second securement web 18 each have a plurality of spaced apart perforations 22 thereon, to provide a gripping surface for receipt of and securement of foam and/or stucco "S" when it is applied thereagainst and onto a surface of a wall "W".

Figure 2:
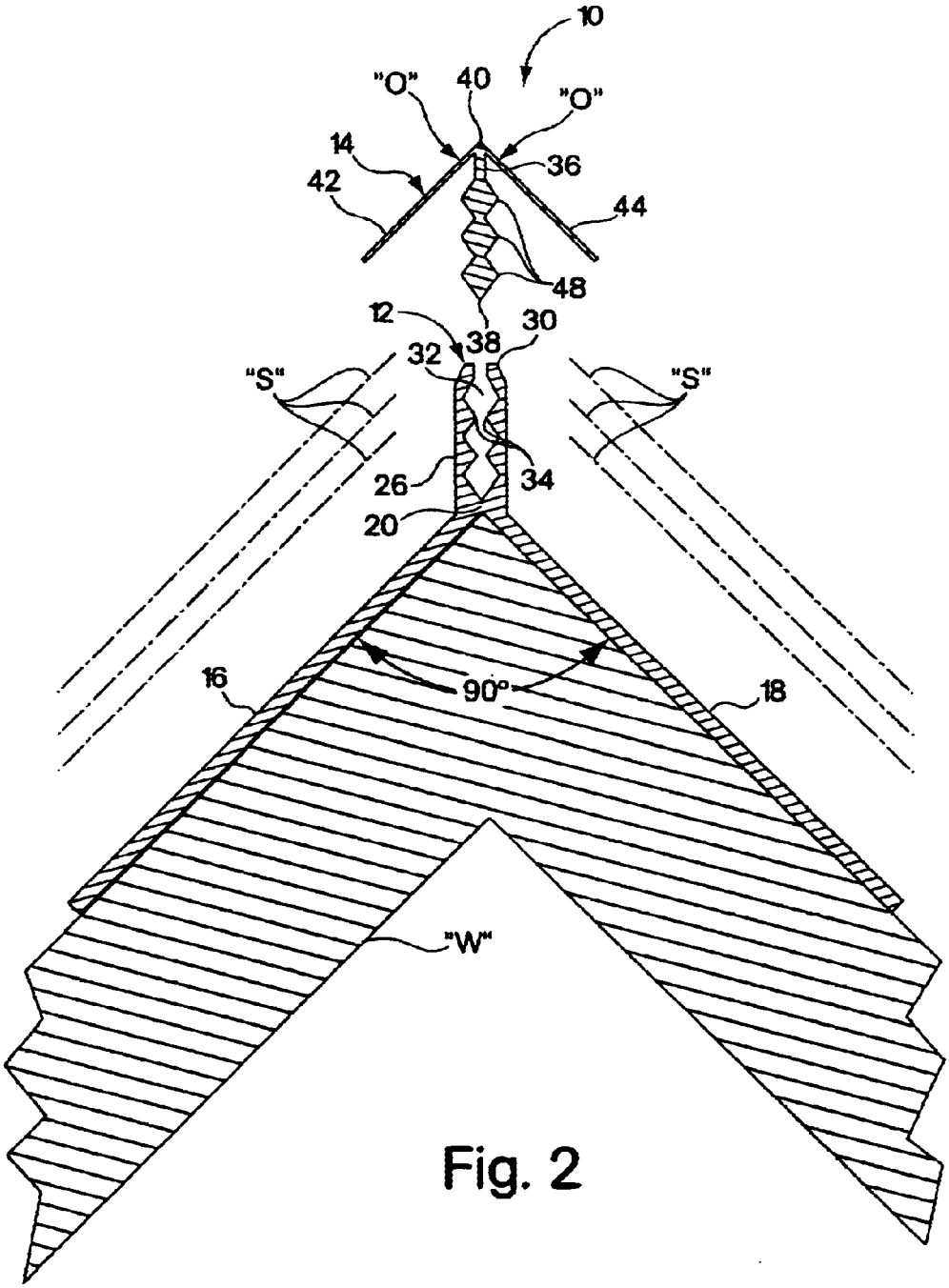
FIG. 2 is a end view of the stucco trim assembly shown in FIG. 1, in an exploded view, on an outside corner wall.

A projecting channel frame 26 is unitary with the juncture 20 of the first securement web 16 and the second securement web 18 and is directed into a direction away from the first and second securement webs 16 and 18, as may be seen in FIGS. 1 and 2. The elongated projecting channel frame 26 has a distalmost edge 30. The distalmost edge 30 of the projecting channel frame 26 has an elongated channel 32 extending therewithin. The elongated channel 32 has a plurality of elongated spaced apart barbs or ribs 34 directed toward one another in an opposing fashion, within the elongated channel 32 of the projecting channel frame 26, as may be best seen in FIG. 2.

The inserted frame clip 14 of the first embodiment of the stucco trim assembly 10 comprises an elongated central frame member 36 having an elongated distalmost edge 38. The elongated central frame member 36 has a second edge 40 which defines a juncture for an elongated first outer web 42 and an elongated second outer web 44 unitarily extruded therewith and adjoined together at the second edge 40 of the elongated central frame member 36. The elongated first outer web 42 and the elongated second outer web 44 each have an outer surface "O" having a rough portion "R" or texture thereon for bonding or securement of foam and/or stucco material thereto. The elongated central frame member 36 has a plurality of elongated spaced apart ribs or barbs 48 on each side thereof in spaced relationship to the opposed barbs 34 spaced apart from one another within the channel 32 of the projecting channel frame member 26 of the receiving trim member 12.

The elongated frame member 36 of the inserted frame clip 14 is designed to be snapped (or slid) into the receiving channel 32 of the projecting channel frame member 26 at successively adjustable depths therewithin, as may be seen in FIG. 2. The spaced apart barbs or ribs 48 on the elongated frame member 36 may be mated with the valleys between adjacent spaced apart and opposed ribs or barbs 34 in the receiving channel 32 of the projecting channel frame 26. The inserted frame clip 14 may therefore define an outer surface "O" which is adjustably matable within the channel 32 of the receiving trim member 16 to permit a foam and/or stucco material "S" to be placed on a wall "W" and on the surface "O" and within the respective web boundaries 16/18 and 42/44 defined by the stucco trim assembly 10, at any of several thicknesses, according to the needs of the construction undertaken.

Figure 3:
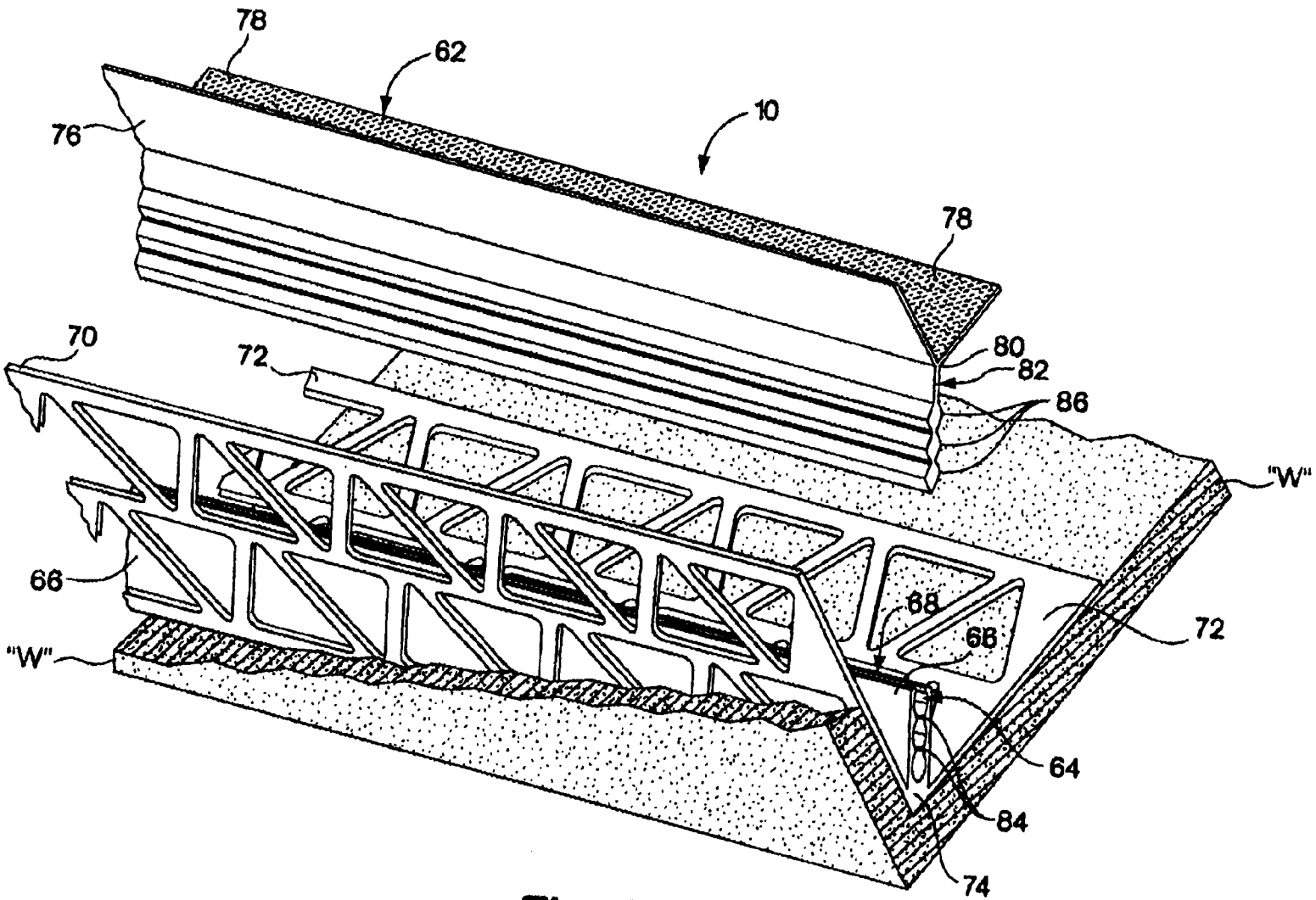
FIG. 3 is a perspective view of a stucco trim assembly for an interior wall corner in an exploded view thereof.
Figure 4:
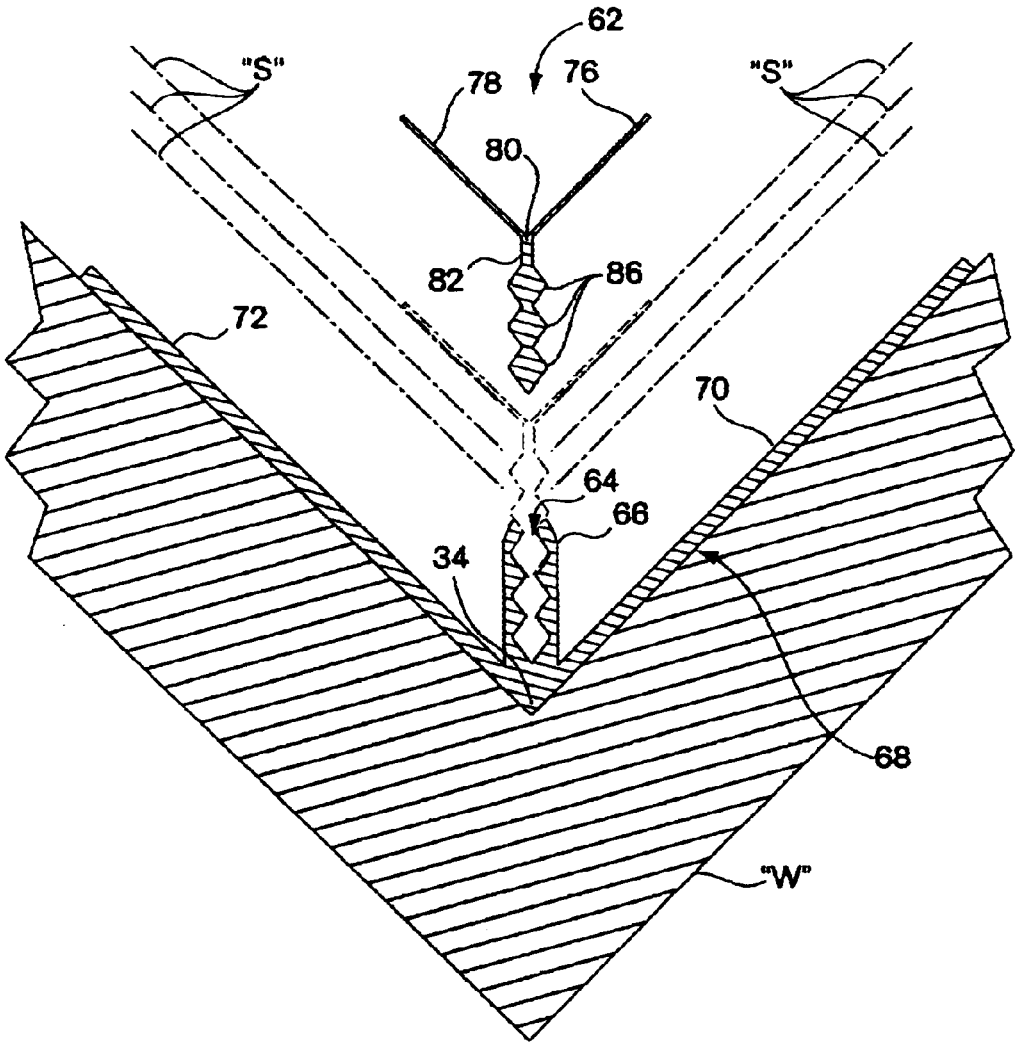
FIG. 4 is an end view of the stucco trim assembly shown in FIG. 3, in an inside wall corner arrangement, the stucco trim assembly being shown in an exploded view thereof.

A further embodiment of the stucco trim assembly 10 comprises a receiving trim member 68 for an inside or inner corner of a pair of walls "W" meeting along an inner corner, as is shown in FIGS. 3 and 4. The stucco trim assembly 10 of this embodiment also includes an inserted frame clip 62 arranged to adjustably mate with an elongated channel 64 in the elongated projecting channel frame 66 of the receiving trim member 68 of the stucco trim assembly 10. The receiving trim member 68 for this embodiment has a first securement web 70 and a second securement web 72 meeting at an elongated juncture 74, the first and second securement webs defining an angle of 90 degrees from one another, as is best seen in FIG. 4. The elongated first and second securement webs 70 and 72 in this embodiment, are bisected by the elongated projecting channel frame member 66. The inserted frame clip 62 of this embodiment has a first outer web 76 and a second out web 78 which meet at an elongated unitary juncture 80 comprising a second edge of the elongated frame portion 82 thereof. The elongated first outer web 76 and the elongated second outer web 78 define an angle of 90 degrees with respect to one another along the elongated juncture 80, as may be seen in FIG. 4. The elongated frame portion 82 of this embodiment has a plurality of spaced apart ribs or barbs 86 arranged in a matter similar to that of the aforementioned first embodiment. The receiving frame portion 66 has an elongated channel disposed 64 within the projecting channel frame portion 66 in a manner similar to that of the aforementioned embodiment. The inserted frame portion 66 of the inserted clip 62 may be thus inserted within the channel 64 of the receiving frame portion 66 into a depth of any one of several distances according to the spaced apart ribs 84 and 86 so as to provide a selective spaced distance for example between the first outer web 76 and the first securement web 70, to permit controlled thickness adjustment of the foam and/or stucco material "S" applied to the surfaces of the wall "W" meeting at the inner wall juncture where the stucco trim assembly 10 of this second embodiment, is placed, as may be seen in FIG. 4.

Thus is what has been shown is a unique extruded wall corner trim assembly which permits guidance for assembly of a MASTERBOND™ stucco structure comprised of an application of foam and stucco to adjacent wall surfaces in a convenient and easily adjustable manner. The elongated outer webs or securement webs each having irregular surface characteristics permit bonding of the foam and/or stucco material thereto, facilitating securement and longevity to the stucco assembly.

I claim:

1. A stucco trim assembly for emplacement onto a corner defined by the juncture of a pair of walls, to permit a foam and stucco material to be controllably and adjustably secured to said walls; said assembly comprising:

an elongated receiving trim member attachable to a corner of said pair of walls; and an elongated inserted frame clip, wherein said clip is adjustably supported in said elongated receiving trim member a spaced distance from said wall, wherein said elongated inserted frame clip comprises a second pair of elongated web members which are joined at an angle at a common elongated juncture for attachment to said walls and where said second pair of web members have surfaces with a roughened texture for gripping of a foam and stucco material applied thereto.

2. The stucco trim assembly as recited in claim 1, wherein said receiving trim member comprises a first pair of elongated web members which are joined at an angle at a common elongated juncture for attachment to said walls.

3. The stucco trim assembly as recited in claim 2, wherein said receiving trim member has a projecting channel frame portion for receiving said elongated inserted frame clip.

4. The stucco trim assembly as recited in claim 2, wherein said first pair of elongated web members are arranged at an angle of about 90 degrees with respect to one another.

5. The stucco trim assembly as recited in claim 3, wherein said second pair of elongated web members are arranged at an angle of about 90 degrees with respect to one another.

6. The stucco trim assembly as recited in claim 2, wherein said first pair of web members have surfaces with a roughened texture for gripping of a foam or stucco material applied thereto.

7. The stucco trim assembly as recited in claim 3, wherein said projecting channel frame portion has an elongated channel therein for receipt of an elongated frame member of said inserted frame clip.

8. The stucco trim assembly as recited in claim 4, wherein said elongated channel in said projecting channel frame portion has a plurality of elongated spaced apart ribs thereon for securely receivingly engaging said inserted frame clip.

9. The stucco assembly as recited in claim 4, wherein said elongated frame member on said inserted frame clip has a plurality of elongated spaced apart ribs thereon for engaging said projecting channel frame portion of said receiving trim member.

* * * * *